US009010294B2

(12) United States Patent
Burrows et al.

(10) Patent No.: US 9,010,294 B2
(45) Date of Patent: Apr. 21, 2015

(54) CORONA IGNITER INCLUDING TEMPERATURE CONTROL FEATURES

(75) Inventors: John Antony Burrows, Northwich (GB); James D. Lykowski, Temperence, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 305 days.

(21) Appl. No.: 13/589,617

(22) Filed: Aug. 20, 2012

(65) Prior Publication Data

US 2013/0049566 A1 Feb. 28, 2013

Related U.S. Application Data

(63) Continuation-in-part of application No. 13/085,991, filed on Apr. 13, 2011.

(60) Provisional application No. 61/323,458, filed on Apr. 13, 2010, provisional application No. 61/432,501, filed on Jan. 13, 2011, provisional application No. 61/525,379, filed on Aug. 19, 2011.

(51) Int. Cl.
*F02P 23/00* (2006.01)
*H01T 13/50* (2006.01)
(Continued)

(52) U.S. Cl.
CPC ..... *H01T 13/50* (2013.01); *F02P 23/04* (2013.01); *H01T 13/16* (2013.01); *H01T 13/467* (2013.01); *H01T 21/02* (2013.01)

(58) Field of Classification Search
CPC ..... F02P 23/00; F02P 9/007; H01T 19/00; H01T 1/00
USPC ..... 123/169 CA, 169 EL, 169 E, 143 B
See application file for complete search history.

(56) References Cited

U.S. PATENT DOCUMENTS 1,312,317 A 8/1919 Gerken
1,610,032 A 12/1926 Beason
(Continued)

FOREIGN PATENT DOCUMENTS

CN 101346859 A 1/2009
DE 3616640 11/1987
FR 2859831 A1 3/2005

*Primary Examiner* — Hai Huynh
(74) *Attorney, Agent, or Firm* — Robert L. Stearns; Dickinson Wright, PLLC

(57) ABSTRACT

A corona igniter 20 with improved temperature control at the firing end is provided. The corona igniter 20 comprises a central electrode 24 include a core material 30, such as copper, surrounded by a clad material 32, such as nickel. The core material 30 extends longitudinally between an electrode terminal end 34 and an electrode firing end 36. The core material 30 is disposed at the electrode terminal end 34 and has a core length $I_c$ equal to at least 90% of an electrode length $I_e$ of the central electrode 24. At least 97% of the core length $I_c$ is surrounded by an insulator 26. The electrode diameter is increased, such that a clad thickness $t_{cl}$ of the central electrode 24 is equal to at least 5% of an insulator thickness $t_i$, and a core diameter $D_c$ is equal to at least 30% of the insulator thickness $t_i$.

36 Claims, 19 Drawing Sheets

(51) Int. Cl.

| | |
|---|---|
| ***F02P 23/04*** | (2006.01) |
| ***H01T 13/16*** | (2006.01) |
| ***H01T 13/46*** | (2006.01) |
| ***H01T 21/02*** | (2006.01) |

(56) References Cited

U.S. PATENT DOCUMENTS

| | | | | |
|---|---|---|---|---|
| 2,320,617 | A | 6/1943 | Landrum | |
| 2,350,731 | A | 6/1944 | Dobrosavijevitch | |
| 2,371,211 | A | 3/1945 | Barrington | |
| 2,871,388 | A | 1/1959 | Adair | |
| 2,906,908 | A | 9/1959 | Marion | |
| 3,119,944 | A | 1/1964 | Lentz et al. | |
| 3,958,144 | A | 5/1976 | Franks | |
| 4,314,392 | A | 2/1982 | Waite | |
| 4,814,665 | A | 3/1989 | Sakura et al. | |
| 4,972,812 | A | 11/1990 | Strumbos | |
| 5,017,826 | A | 5/1991 | Oshima et al. | |
| 5,578,894 | A | 11/1996 | Oshima | |
| 5,623,179 | A | 4/1997 | Buhl | |
| 5,990,602 | A | 11/1999 | Katoh et al. | |
| 6,329,743 | B1 | 12/2001 | Camilli | |
| 6,357,223 | B1 | 3/2002 | Caren et al. | |
| 6,608,430 | B1 | 8/2003 | Schaus | |
| 6,617,706 | B2 | 9/2003 | Matsubara et al. | |
| 6,628,049 | B2 | 9/2003 | Rosenthal et al. | |
| 7,305,954 | B2 * | 12/2007 | Hagiwara et al. | 123/143 B |
| 7,328,677 | B2 * | 2/2008 | Hagiwara et al. | 123/143 B |
| 7,382,084 | B2 | 6/2008 | Yoshimoto et al. | |
| 7,615,914 | B2 | 11/2009 | Francesconi et al. | |
| 7,823,556 | B2 | 11/2010 | Lykowski et al. | |
| 7,847,472 | B2 | 12/2010 | Suzuki et al. | |
| 7,944,134 | B2 | 5/2011 | Kyuno et al. | |
| 8,082,897 | B2 * | 12/2011 | Kato et al. | 123/169 EL |
| 8,215,277 | B2 * | 7/2012 | Suzuki et al. | 123/169 E |
| 8,434,443 | B2 * | 5/2013 | Lykowski et al. | 123/169 R |
| 8,729,782 | B2 * | 5/2014 | Lykowski et al. | 313/141 |
| 8,749,126 | B2 * | 6/2014 | Durham et al. | 313/141 |
| 2005/0057135 | A1 | 3/2005 | Yoshimoto et al. | |
| 2006/0066194 | A1 | 3/2006 | Morin | |
| 2007/0114898 | A1 * | 5/2007 | Nagasawa et al. | 313/141 |
| 2007/0114901 | A1 * | 5/2007 | Nagasawa et al. | 313/141 |
| 2007/0188063 | A1 | 8/2007 | Lykowski | |
| 2010/0045157 | A1 * | 2/2010 | Nguyen | 313/143 |
| 2010/0083942 | A1 | 4/2010 | Lykowski et al. | |
| 2010/0165539 | A1 * | 7/2010 | Sakakura | 361/253 |
| 2010/0175653 | A1 | 7/2010 | Lykowski et al. | |
| 2011/0037370 | A1 | 2/2011 | Ma et al. | |
| 2011/0146640 | A1 * | 6/2011 | Achstaetter et al. | 123/608 |
| 2012/0192824 | A1 * | 8/2012 | Burrows et al. | 123/143 B |

* cited by examiner

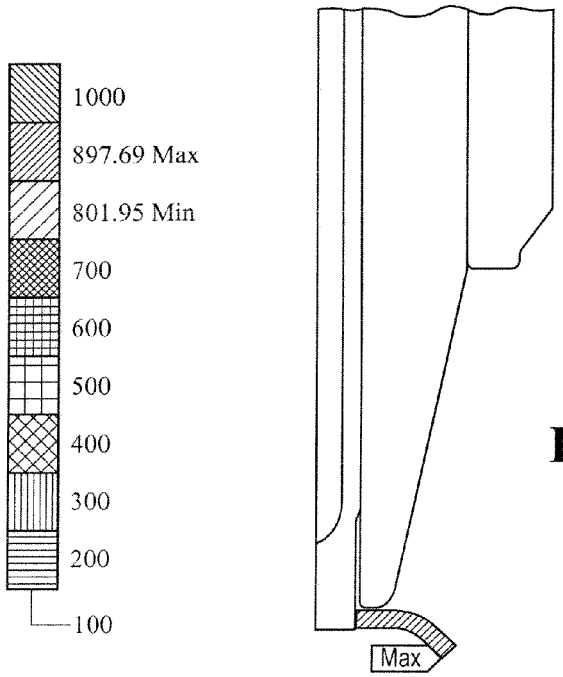
FIG. 8E
FIG. 9
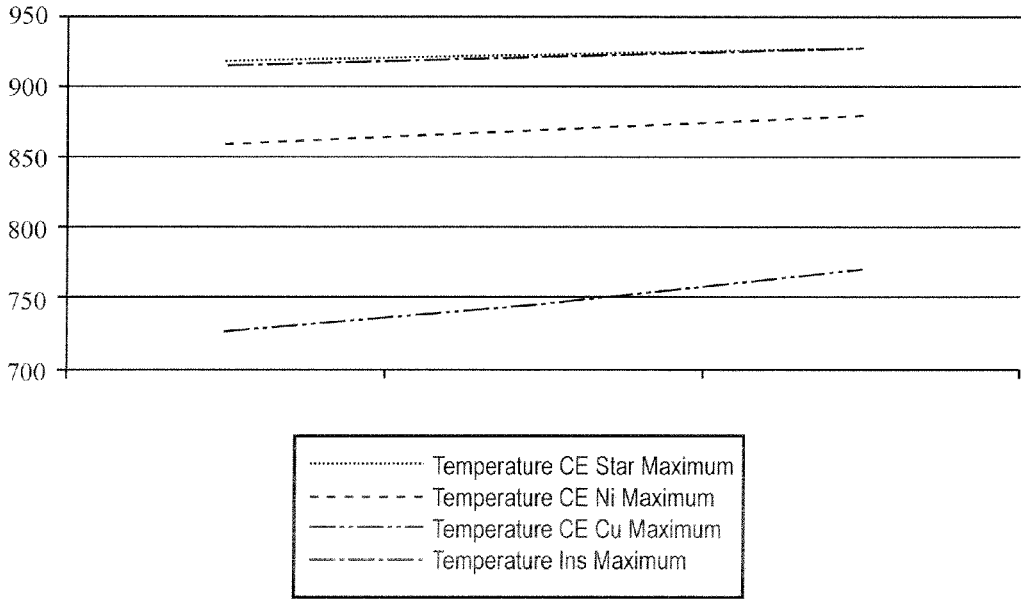

CORONA IGNITER INCLUDING TEMPERATURE CONTROL FEATURES

CROSS REFERENCE TO RELATED APPLICATION

This application is a continuation-in-part of U.S. patent application Ser. No. 13/085,991, filed Apr. 13, 2011, which claims priority to provisional application Ser. No. 61/323,458, filed Apr. 13, 2010, and provisional application Ser. No. 61/432,501, filed Jan. 13, 2011, the entire contents of which are hereby incorporated by reference. This application also claims the benefit of U.S. provisional application Ser. No. 61/525,379, filed Aug. 19, 2011, the entire contents of which is hereby incorporated by reference.

BACKGROUND OF THE INVENTION

1. Field of the Invention

This invention relates generally to a corona igniter for emitting a radio frequency electric field to ionize a fuel-air mixture and provide a corona discharge, and more particularly to controlling the temperature of the corona igniter during operation.

2. Related Art

A corona igniter of a corona discharge ignition system receives a voltage from a power source and emits an electrical field that forms a corona to ionize a mixture of fuel and air of an internal combustion engine. The igniter includes a central electrode extending longitudinally form an electrode terminal end to an electrode firing end. An insulator is disposed along the central electrode, and a shell is disposed along the insulator.

The electrode terminal end receives the voltage from the power source and the electrode firing end emits the electrical field that forms the corona. The electrical field includes at least one streamer, and typically a plurality of streamers forming the corona. The corona igniter does not include any grounded electrode element in close proximity to the electrode firing end. Rather, the mixture of air and fuel is ignited along the entire length of the high electrical field generated from the electrode firing end. An example of a corona igniter is disclosed in U.S. Patent Application Publication No. US 2010/0083942 to the present inventor, Lykowski et al.

In internal combustion engine applications, the temperature of the corona igniter, especially at the firing end, impacts ignition performance. Corona igniters of the prior art oftentimes reach undesirable temperatures at the firing end, such as temperatures greater than 950° C. Such high temperatures are likely to degrade the quality of ignition. The corona igniter can experience reduced endurance or other combustion problems.

SUMMARY OF THE INVENTION

One aspect of the invention provides a corona igniter for providing a corona discharge. The corona igniter includes a central electrode extending longitudinally from an electrode terminal end to an electrode firing end. The central electrode includes a core material surrounded by a clad material. Each of the materials of the central electrode have a thermal conductivity, and the thermal conductivity of the core material is greater than the thermal conductivity of the clad material. An insulator formed of an electrically insulating material is disposed around the central electrode. A shell formed of an electrically conductive material is disposed around the insulator. In this embodiment, the core material of the central electrode is disposed at the electrode terminal end.

Another aspect of the invention provides a corona igniter comprising a central electrode having an electrode length extending longitudinally from an electrode terminal end to an electrode firing end. The central electrode includes a core material surrounded by a clad material, wherein each of the materials of the central electrode have a thermal conductivity, and the thermal conductivity of the core material is greater than the thermal conductivity of the clad material. The core material of the central electrode presents a core length extending longitudinally between the electrode terminal end and the electrode firing end. The corona igniter also includes an insulator formed of an electrically insulating material disposed around the central electrode and extending longitudinally from an insulator upper end to an insulator nose end. A shell formed of an electrically conductive material is disposed around the insulator. The core length of the core material is equal to at least 90% of the electrode length of the central electrode, and at least 97% of the core length of the core material is surrounded by the insulator.

Yet another aspect provides a corona igniter comprising a central electrode extending longitudinally from an electrode terminal end to an electrode firing end. The central electrode includes a core material surrounded by a clad material. Each of the materials have a thermal conductivity, and the thermal conductivity of the core material is greater than the thermal conductivity of the clad material. An insulator formed of an electrically insulating material is disposed around the central electrode, and a shell formed of an electrically conductive material is disposed around the insulator. The insulator has an insulator outer surface facing the shell and an insulator inner surface facing the central electrode. The insulator outer surface and the insulator inner surface present an insulator thickness therebetween. The clad material of the central electrode has a clad outer surface facing the insulator inner surface and a clad inner surface facing the core material. The clad outer surface and the clad inner surface present a clad thickness therebetween. The core material of the central electrode has a core outer surface facing the clad inner surface, and the core outer surface presents a core diameter. The clad thickness is equal to at least 5% of the insulator thickness, and the core diameter is equal to at least 30% of the insulator thickness.

The central electrode of the corona igniter, which includes a core material having a high thermal conductivity, along with the geometry of the insulator and the central electrode, reduces the operating temperature at the firing end of the corona igniter, compared to corona igniters of the prior art without the improved geometry and without the clad and core materials. Test results indicated that the operating temperature at the electrode firing end of the inventive corona igniter can be less than the operating temperature at the electrode firing end of corona igniters of the prior art by approximately 100° C. or more. The test results also indicate the operating temperature at the insulator nose end of the inventive corona igniter can also be significantly less than the temperatures of the prior art.

BRIEF DESCRIPTION OF THE DRAWINGS

Other advantages of the present invention will be readily appreciated, as the same becomes better understood by reference to the following detailed description when considered in connection with the accompanying drawings wherein:

FIGS. 8A-8E provide FEAs of the corona igniter of FIG. 7;

FIG. 9 is a graph of the FEA test results of FIGS. 6-8.

DETAILED DESCRIPTION

Figure 1:
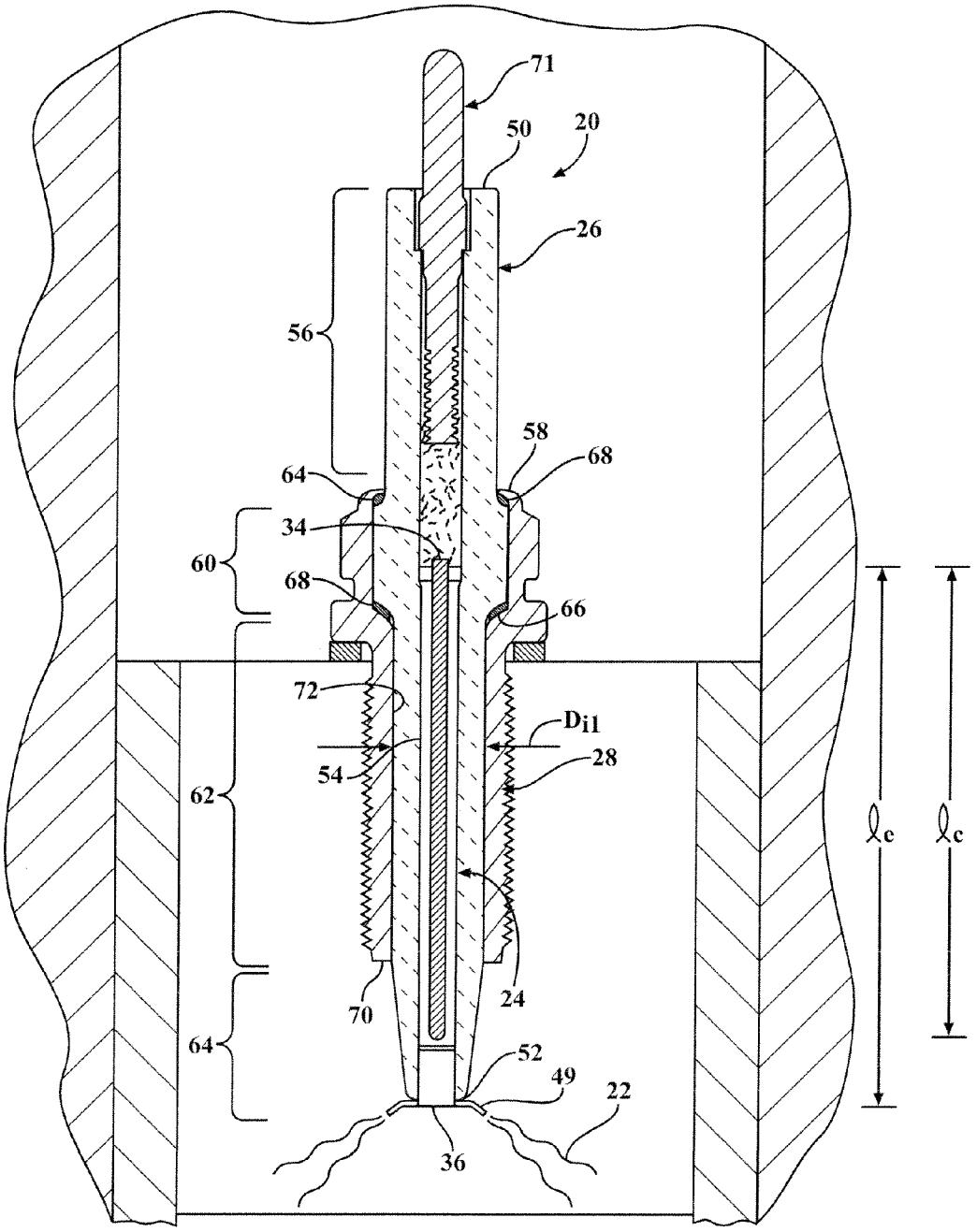
FIG. 1 is a cross-sectional view of a corona igniter in accordance with one aspect of the invention.
Figure 1A:
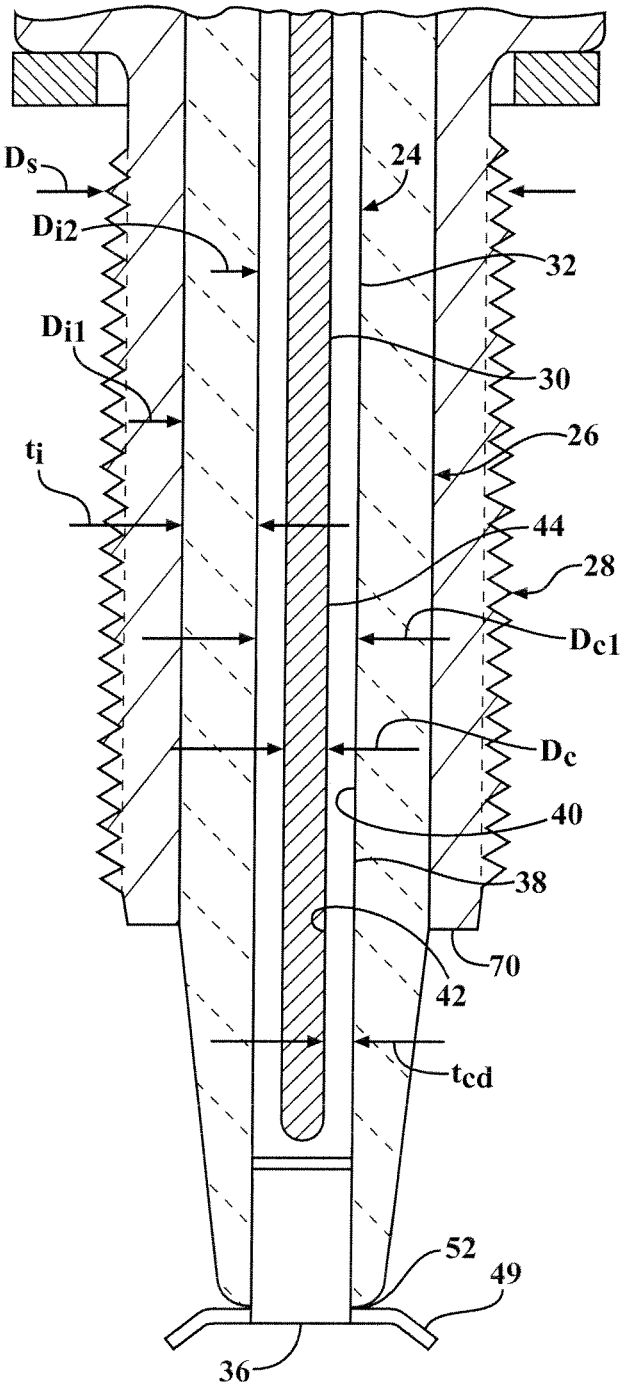
FIG. 1A is an enlarged view of a portion of the corona igniter of FIG. 1.
Figure 2:
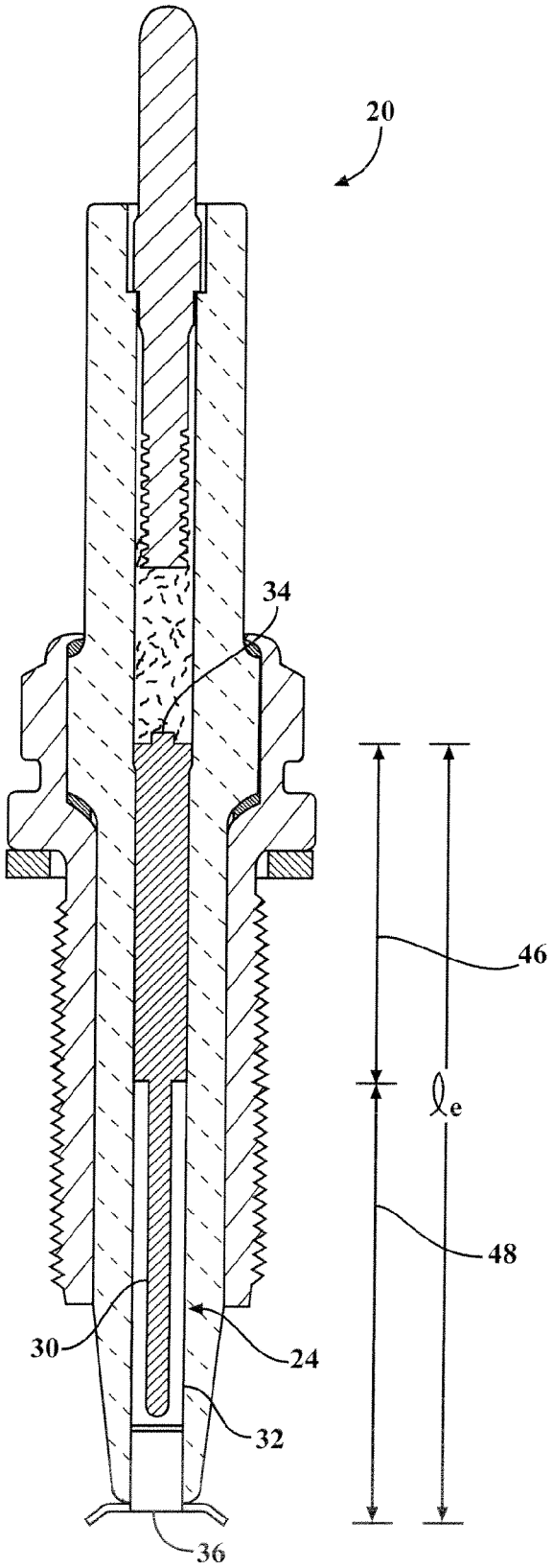
FIG. 2 is a cross-sectional view of a corona igniter in accordance with another aspect of the invention.
Figure 3:
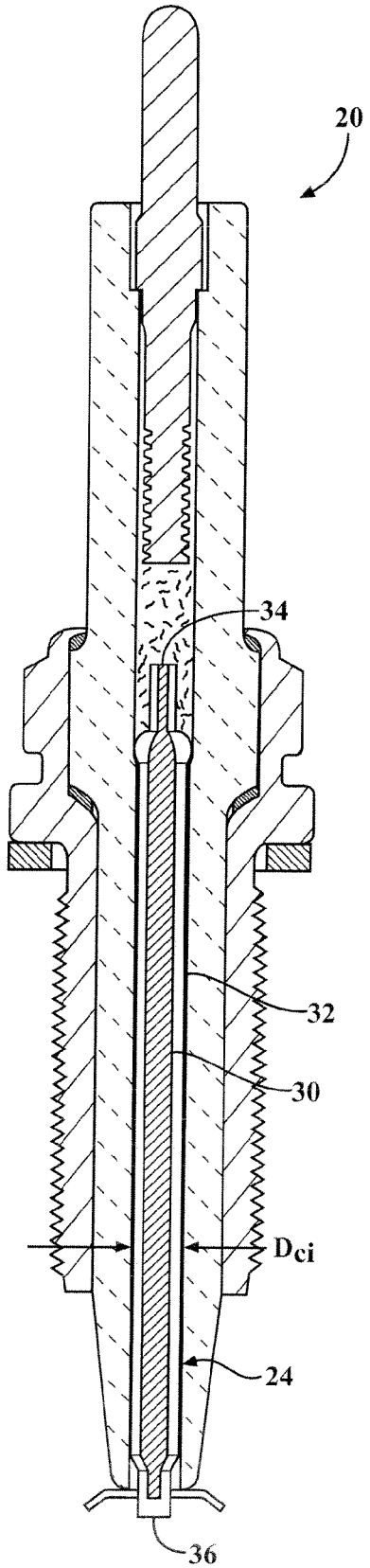
FIG. 3 is a cross-sectional view of a corona igniter in accordance with yet another aspect of the invention.

The invention provides a corona igniter 20, such as those shown in FIGS. 1-3, for use in a corona discharge ignition system designed to intentionally create an electrical source which suppresses the formation of an arc and promotes the creation of strong electrical fields which produce corona discharge 22. The corona igniter 20 includes a central electrode 24, an insulator 26 surrounding the central electrode 24, and a shell 28 surrounding the insulator 26. The central electrode 24 includes a core material 30, such as copper or a copper alloy, surrounded by a clad material 32, such as nickel or a nickel alloy. The core material 30 and clad material 32 have a thermal conductivity, and the thermal conductivity of the core material 30 is greater than the thermal conductivity of the clad material 32. This feature of the central electrode 24, along with the geometry of the insulator 26 and central electrode 24, reduces the operating temperature at the firing end of the corona igniter 20, compared to corona igniters of the prior art, which do not have the improved geometry or the clad and core materials.

In one embodiment, the central electrode 24 extends from an electrode terminal end 34 to an electrode firing end 36, and the core material 30 of the central electrode 24 is disposed at the electrode terminal end 34. In another embodiment, the central electrode 24 has an electrode length $I_e$ extending from the electrode terminal end 34 to the electrode firing end 36, the core material 30 has a core length $I_c$ extending longitudinally between the electrode terminal end 34 and the electrode firing end 36, the core length $I_c$ of the core material 30 is equal to at least 90% of the electrode length $I_e$ of the central electrode 24, and at least 97% of the core length $I_c$ of the core material 30 is surrounded by the insulator 26. In yet another embodiment, the central electrode 24 has an increased diameter, provided by a clad thickness ($t_{cl}$) being equal to at least 5% of the insulator thickness ($t_i$) and the core diameter ($D_c$) being equal to at least 30% of the insulator thickness ($t_i$). Each of these embodiments provides reduced temperatures at the firing end of the corona igniter 20, compared to temperatures of corona igniters of the prior art.

Although the prior art provides spark plugs that include an insulator surrounding a central electrode, wherein the central electrode comprises a nickel clad and a copper core, the geometry of the insulator and central electrode taught by the prior art related to spark plugs is not suitable for use in a corona ignition system and does not provide the reduced operating temperatures achieved by the subject invention. Considerable parasitic capacitance results when the insulator and central electrode of the prior art spark plugs are used in a corona ignition system. In addition, insulators used in corona igniters of the prior art oftentimes require a central electrode having a small diameter which precludes the use of a core material.

The corona igniter 20 of the present invention is typically used in an internal combustion engine of an automotive vehicle or industrial machine. As shown in FIG. 1, the corona igniter 20 is typically disposed in a cylinder block having a side wall extending circumferentially around a cylinder center axis and presenting a space having a cylindrical shape. The side wall of the cylinder block has a top end surrounding a top opening, and a cylinder head is disposed on the top end and extends across the top opening. A piston is disposed in the cylindrical space and along the side wall of the cylinder block for sliding along the side wall during operation of the internal combustion engine. The piston is spaced from the cylinder head such that the cylinder block and the cylinder head and the piston provide the combustion chamber therebetween. The combustion chamber contains the combustible fuel-air mixture ionized by the corona igniter 20. The cylinder head includes an access port receiving the corona igniter 20, and the corona igniter 20 extends transversely into the combustion chamber. The corona igniter 20 receives a high radio frequency voltage from a power source (not shown) and emits the radio frequency electric field to ionize a portion of the fuel-air mixture and form the corona discharge 22. The ignition event of the corona discharge ignition system includes multiple electrical discharges running at approximately 1 megahertz.

The central electrode 24 of the corona igniter 20 presents an electrode length $I_e$ extending longitudinally along a center axis from the electrode terminal end 34 to the electrode firing end 36. The electrode terminal end 34 receives energy at a high radio frequency AC voltage, typically a voltage up to 40,000 volts, a current below 1 ampere, and a frequency of 0.5 to 5.0 megahertz.

The core material 30 of the central electrode 24 is typically copper or a copper alloy, but can comprise any material having a thermal conductivity greater than the clad material 32. Likewise, although the clad material 32 is typically nickel or a nickel alloy, the clad material 32 can comprise any material having a thermal conductivity less than the core material 30. The clad material 32 also preferably has a high electrical conductivity and corrosion resistance greater than the core material 30. The materials 30, 32 of the central electrode 24 should also have an electrical resistivity of below 1,200 nΩ·m.

The clad material 32 of the corona igniter 20 has a clad outer surface 38 facing the insulator inner surface 40 and a clad inner surface 42 facing the core material 30. The clad outer surface 38 and the clad inner surface 42 present a clad thickness $t_{cl}$ therebetween. The core material 30 has a core outer surface 44 facing the clad inner surface 42 which presents a core diameter $D_c$. The core material 30 also presents the core length $I_c$ extending longitudinally between the electrode terminal end 34 and the electrode firing end 36.

In one embodiment, as shown in FIG. 1, the core material 30 extends outwardly of the clad material 32 at the electrode terminal end 34. The core material 30 is also longitudinally spaced about 2 mm from the electrode firing end 36 by the clad material 32. In this embodiment, the core length $I_c$ is equal to about 90% of the electrode length $I_e$, and the entire core length $I_c$ is surrounded by the insulator 26.

In the embodiment of FIG. 2, the central electrode 24 includes a top section 46 and a bottom section 48. At least 40% of the electrode length $I_e$ of the central electrode 24 forms the top section 46, and at least 40% of the electrode length $I_e$ of the central electrode 24 forms the bottom section 48. In this case, the top section 46 extends from the electrode terminal end 34 to the bottom section 48, and the bottom section 48 extends from the top section 46 to the electrode firing end 36. The bottom section 48 includes the core material 30 surrounded by the clad material 32, and the top section 46 consists entirely of the core material 30. The two sections 46, 48 may be joined by any method providing suitable thermal and electrical contact, as well as mechanical stability. Exemplary methods include co-extrusion, welding, brazing, soldering, and crimping.

In yet another embodiment, as shown in FIG. 3, the central electrode 24 comprises a tube formed of the clad material 32 surrounding, or filled with, the core material 30. The central electrode 24 of this embodiment can also include a head at the electrode terminal end 34. In one embodiment, the head closes off the core material 30 of the tube and is done by upsetting, swaging, or another process. The core material 30 can also be spaced from the electrode terminal end 34 by the clad material 32 and thus can be sealed off from the combustion environment. In this embodiment, the clad diameter $D_{cl}$ decreases toward the electrode firing end 36. Several methods can be used to seal off the core material 30 from the electrode firing end 36, such as swaging, crimping, brazing, soldering, welding, or capping with another component.

The central electrode 24 typically includes a firing tip 49 surrounding and adjacent the electrode firing end 36, as shown in FIGS. 1-3, for emitting the radio frequency electric field to ionize a portion of the fuel-air mixture and provide the corona discharge 22 in the combustion chamber. The firing tip 49 is formed of an electrically conductive material providing exceptional thermal performance at high temperatures, for example a material including at least one element selected from Groups 4-12 of the Periodic Table of the Elements. The firing tip 49 can include a plurality of prongs, such that the diameter of the firing tip 49 is greater than the diameter of the central electrode 24. In this embodiment, the firing tip 49 can be referred to as a star.

The central electrode 24 of the corona igniter 20 is surrounded by the insulator 26. The insulator 26 extends longitudinally from an insulator upper end 50 to an insulator nose end 52. A portion of the insulator 26 is disposed annularly around and longitudinally along the central electrode 24. The insulator nose end 52 is typically disposed adjacent the firing tip 49 or spaced slightly from the firing tip 49.

The insulator 26 is formed of an electrically insulating material, typically a ceramic material including alumina. The insulator 26 has an electrical conductivity less than the electrical conductivity of the central electrode 24 and the shell 28. In one embodiment, the insulator 26 has a dielectric strength of 14 to 25 kV/mm. The insulator 26 also has a relative permittivity capable of holding an electrical charge, typically a relative permittivity of 6 to 12. In one embodiment, the insulator 26 has a coefficient of thermal expansion (CTE) between $2\times10^{-6}$/° C. and $10\times10^{-6}$/° C.

The insulator 26 includes an insulator inner surface 40 facing the central electrode 24 and extending longitudinally along the electrode center axis from the insulator upper end 50 to the insulator nose end 52. The insulator inner surface 40 presents an insulator bore receiving the central electrode 24 and may include an electrode seat for supporting the head of the central electrode 24, as shown in FIGS. 1-3. The corona igniter 20 may include air gaps between the insulator 26 and central electrode 24 or between the insulator 26 and shell 28. These gaps may be filled with a thermally conductive material, such as a metal or ceramic-loaded epoxy, to reduce energy loss.

The insulator 26 of the corona igniter 20 includes an insulator outer surface 54 facing opposite the insulator inner surface 40. The insulator 26 also presents an insulator thickness $t_i$ between the insulator inner surface 40 and the insulator outer surface 54. The insulator outer surface 54 faces outwardly toward the shell 28 and away from the central electrode 24. In one embodiment, the insulator 26 is designed to fit securely in the shell 28.

As shown in FIGS. 1-3, the insulator 26 includes an insulator first region 56 extending outwardly from the shell 28 to the insulator upper end 50. The insulator 26 also includes an insulator middle region 60 extending from the insulator first region 56 toward the insulator nose end 52, and an insulator second region 62 extending from the insulator middle region 60 toward the insulator nose end 52. The insulator outer diameter $D_{i1}$ of the insulator middle region 60 is greater than the insulator outer diameter $D_{i1}$ of the insulator first region 56 and greater than the insulator outer diameter $D_{i1}$ of the insulator second region 62. In one embodiment, the insulator outer diameter $D_{i1}$, of the insulator second region 62 adjacent the central electrode 24 is from 7.0 mm to 12.5 mm.

The insulator 26 also includes an insulator upper shoulder 64 between the insulator first region 56 and the insulator middle region 60, and an insulator lower shoulder 66 between the insulator middle region 60 and the insulator second region 62. The insulator upper shoulder 64 extends radially outwardly from the insulator first region 56 to the insulator middle region 60, and the insulator lower shoulder 66 extends radially inwardly from the insulator middle region 60 to the insulator second region 62. The corona igniter 20 typically includes a pair of gaskets 68 disposed between the insulator 26 and the shell 28, wherein one of the gaskets 68 is disposed along the insulator upper shoulder 64 and the other is disposed along the insulator lower shoulder 66. The insulator geometry and placement of the gaskets 68 allows the insulator 26 to have an insulator thickness $t_i$ great enough to provide exceptional mechanical and electrical strength and reduce the parasitic capacitance from the corona igniter 20. The insulator geometry and placement of the gaskets 68 also allows the central electrode 24 having the increased diameter, compared to prior art central electrodes, to be disposed in the insulator bore.

The insulator 26 also includes an insulator nose region 69 extending from the insulator second region 62 to the insulator nose end 52. The insulator outer diameter $D_{i1}$ of the insulator nose region 69 tapers from the insulator second region 62 to the insulator nose end 52. The insulator outer diameter $D_{i1}$ at the insulator nose end 52 is typically less than the diameter of the firing tip 49.

The corona igniter 20 also includes a terminal 71 formed of an electrically conductive material received in the insulator bore. The terminal 71 includes a first terminal end electrically connected to a terminal wire (not shown), which is electrically connected to the power source (not shown). The terminal 71 also includes a second terminal end in electrical communication with the central electrode 24. Thus, the terminal 71 receives the high radio frequency voltage from the power source and transmits the high radio frequency voltage to the central electrode 24. A conductive seal layer 73 formed of an electrically conductive material is disposed between and electrically connects the terminal 71 and the central electrode 24 so that the energy can be transmitted from the terminal 71 to the central electrode 24.

The shell 28 of the corona igniter 20 is disposed annularly around the insulator 26. The shell 28 is formed of an electrically conductive metal material, such as steel. In one embodiment, the shell 28 has a low electrical resistivity of below 1,200 nΩ·m. As shown in FIG. 1, the shell 28 extends longitudinally along the insulator 26 from a shell upper end 58 to a shell lower end 70. The shell 28 includes a shell inner surface 72 facing the insulator outer surface 54 and extending longitudinally from the insulator first region 56 along the insulator upper shoulder 64 and the insulator middle region 60 and the insulator lower shoulder 66 and the insulator second region 62 to the shell lower end 70, which is adjacent the insulator nose region 69. The shell inner surface 72 presents a shell bore receiving the insulator 26. The shell inner surface 72 also presents a shell diameter $D_s$ extending across the shell bore. The shell diameter $D_s$ is greater than the insulator outer diameter $D_{i1}$ of the insulator nose region 69 and the insulator second region 62. Thus, the insulator 26 can be inserted into the shell bore, and at least a portion of the insulator nose region 69 projects outwardly of the shell lower end 70. The shell 28 surrounds the insulator lower shoulder 66, the insulator middle region 60, and the insulator upper shoulder 64. The shell upper end 58 is typically clamped around the gasket 68 on the insulator upper shoulder 64 to fix the shell 28 in position relative to the insulator 26.

The corona igniter 20 can comprise several difference geometries providing the reduced operating temperatures, compared to corona igniters of the prior art. FIGS. 1-3 show examples of preferred geometries. The reduced operating temperatures may also be achieved when the core material 30 of the central electrode 24 extends along a significant portion of the central electrode 24. The core length $I_c$ of the core material 30 is typically equal to at least 90% of the electrode length $I_e$ of the central electrode 24. Further, at least 97% of the core length $I_c$ is surrounded radially by the insulator 26. The reduced operating temperatures may also be achieved when the central electrode 24 has an increased diameter, such as when the clad thickness $t_{cl}$ equal to at least 5% or at least 13% of the insulator thickness $t_i$ and the core diameter $D_c$ is equal to at least 30% of the insulator thickness $t_i$. In another embodiment, the core diameter $D_c$ is equal to at least 65% or at least 68% of the insulator thickness $t_i$.

Exceptional heat transfer and temperature reduction can also be achieved when the core diameter $D_c$ is equal to at least 65% of the clad diameter $D_{cl}$. The central electrode 24 is also preferably designed so that at least 80% of the electrode length $I_e$ is disposed between the insulator lower shoulder 66 and the insulator nose end 52. A small portion of the central electrode 24, including the electrode terminal end 34, may be disposed outwardly of the insulator nose end 52. Preferably less than 5% of the electrode length $I_e$ is disposed outwardly of the insulator nose end 52.

The insulator thickness $t_i$ also contributes to the reduced temperatures at the firing end and reduced parasitic capacitance from the corona igniter 20, compared to the prior art. The insulator thickness $t_i$ is typically equal to at least 20% of the shell diameter $D_s$. In one embodiment, the insulator thickness $t_i$ is from 2.5 mm to 3.4 mm. This increased insulator thickness $t_i$ is achieved in part by the placing the gaskets 68 on the insulator shoulders 64, 66 adjacent the insulator middle region 60, which has an increased insulator outer diameter $D_{i1}$. In one preferred embodiment, shell diameter $D_s$ is from 11.75 mm to 12.25 mm, the insulator thickness $t_i$ is from 2.75 mm to 3.00 mm, the clad thickness $t_{cl}$ is from 0.25 mm to 0.35 mm, and the core diameter $D_c$ is from 1.4 mm to 1.7 mm. In another preferred embodiment, the insulator outer diameter $D_{i1}$ is from 7.0 mm to 12.5 mm adjacent the central electrode 24, the insulator inner diameter $D_{i2}$ is from 2.19 mm to 2.25 mm adjacent the central electrode 24, and the clad diameter $D_{cl}$ is from 2.14 mm to 2.18 mm along the insulator 26.

Figure 4:
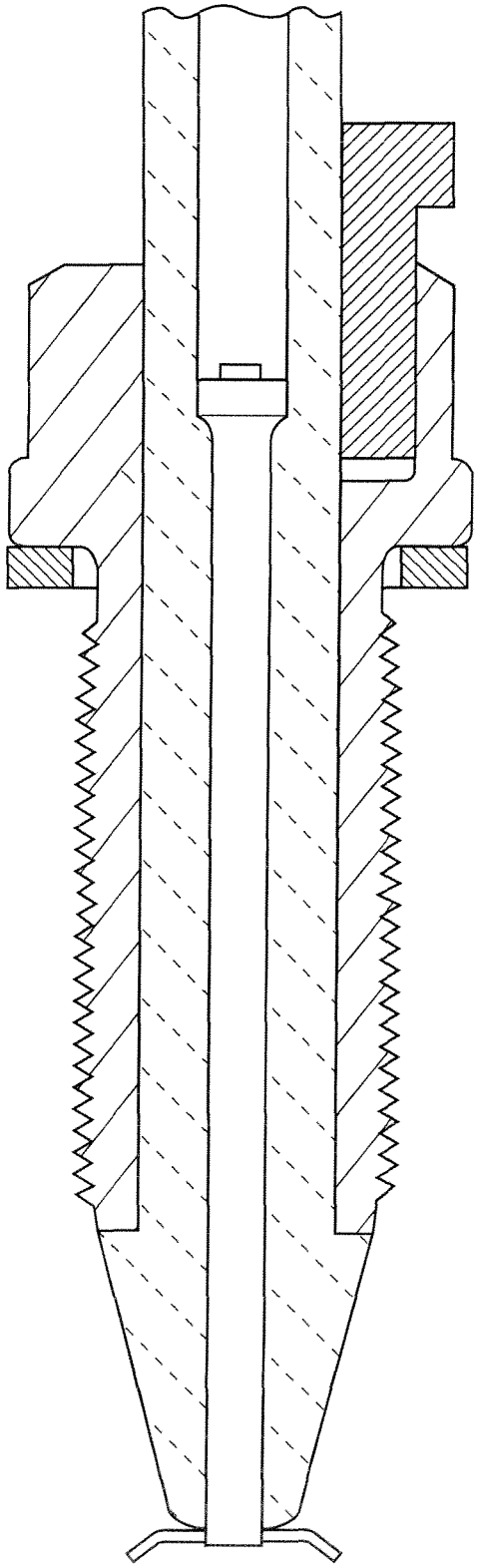
FIG. 4 Prior Art
FIG. 4 is a cross-sectional view of a corona igniter of the prior art.
Figure 5A:
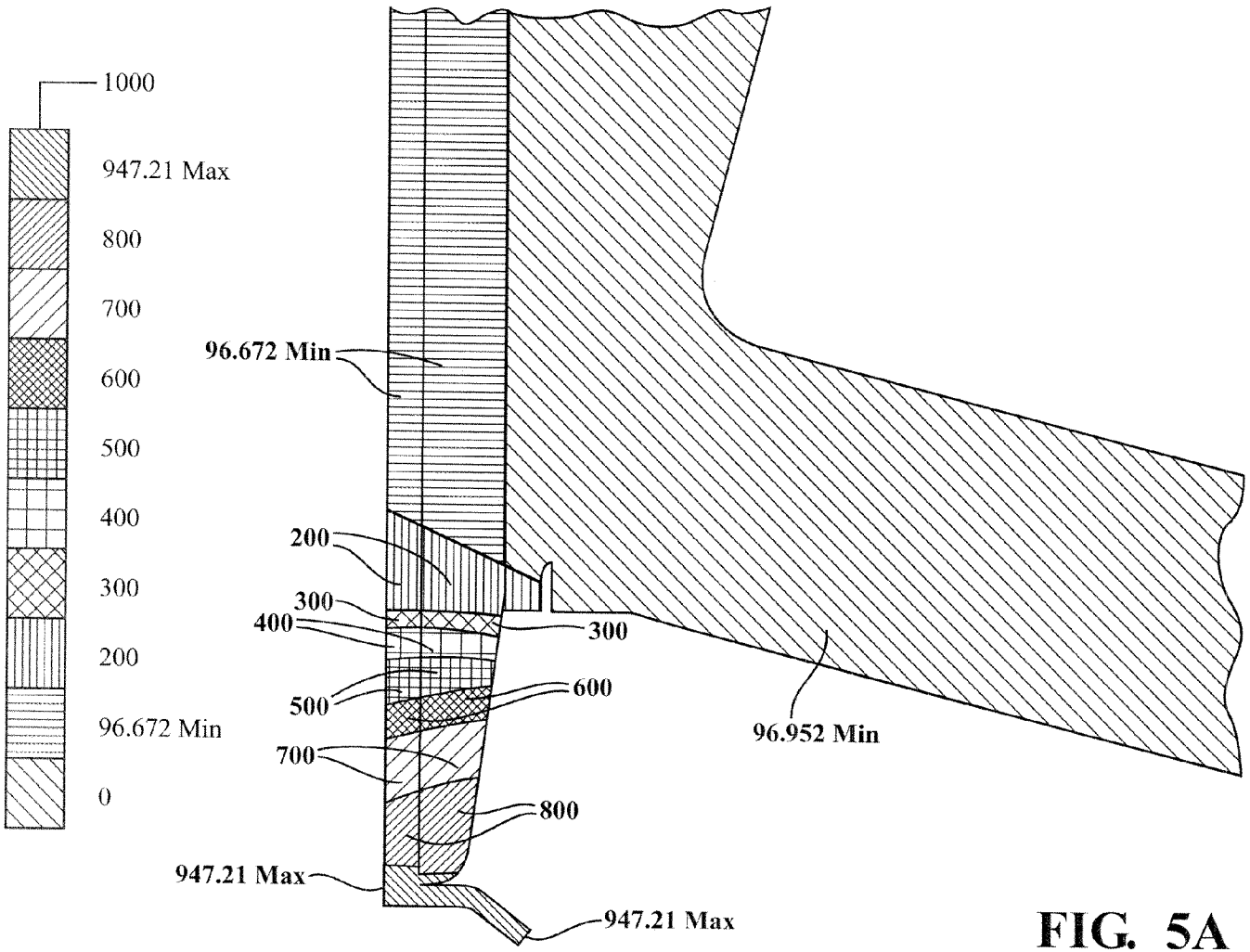
FIG. 5A provides a Finite Element Analysis (FEA) of a corona igniter of the prior art.
Figure 5B:
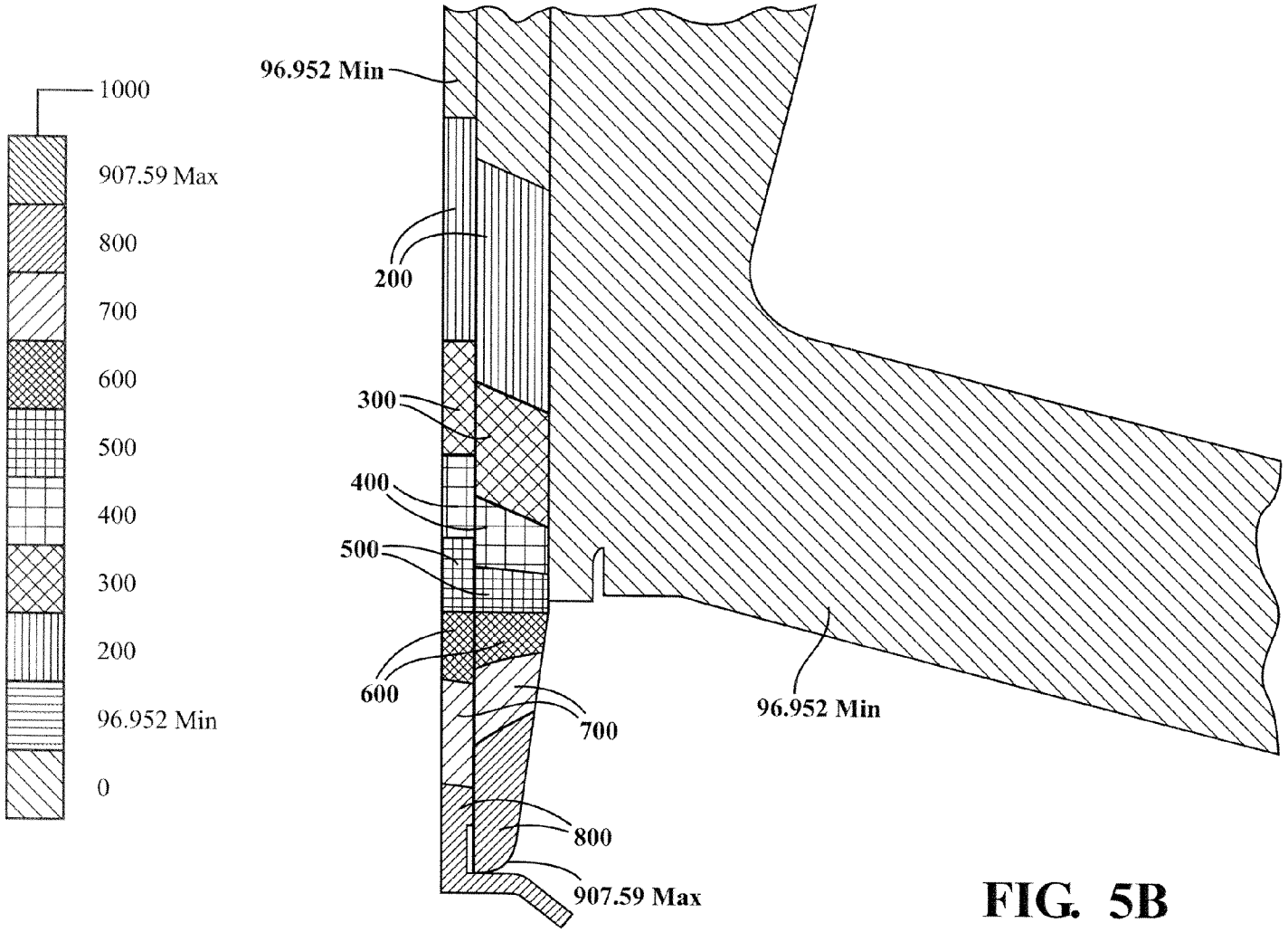
FIG. 5B provides a FEA of another corona igniter of the prior art.
Figure 5C:
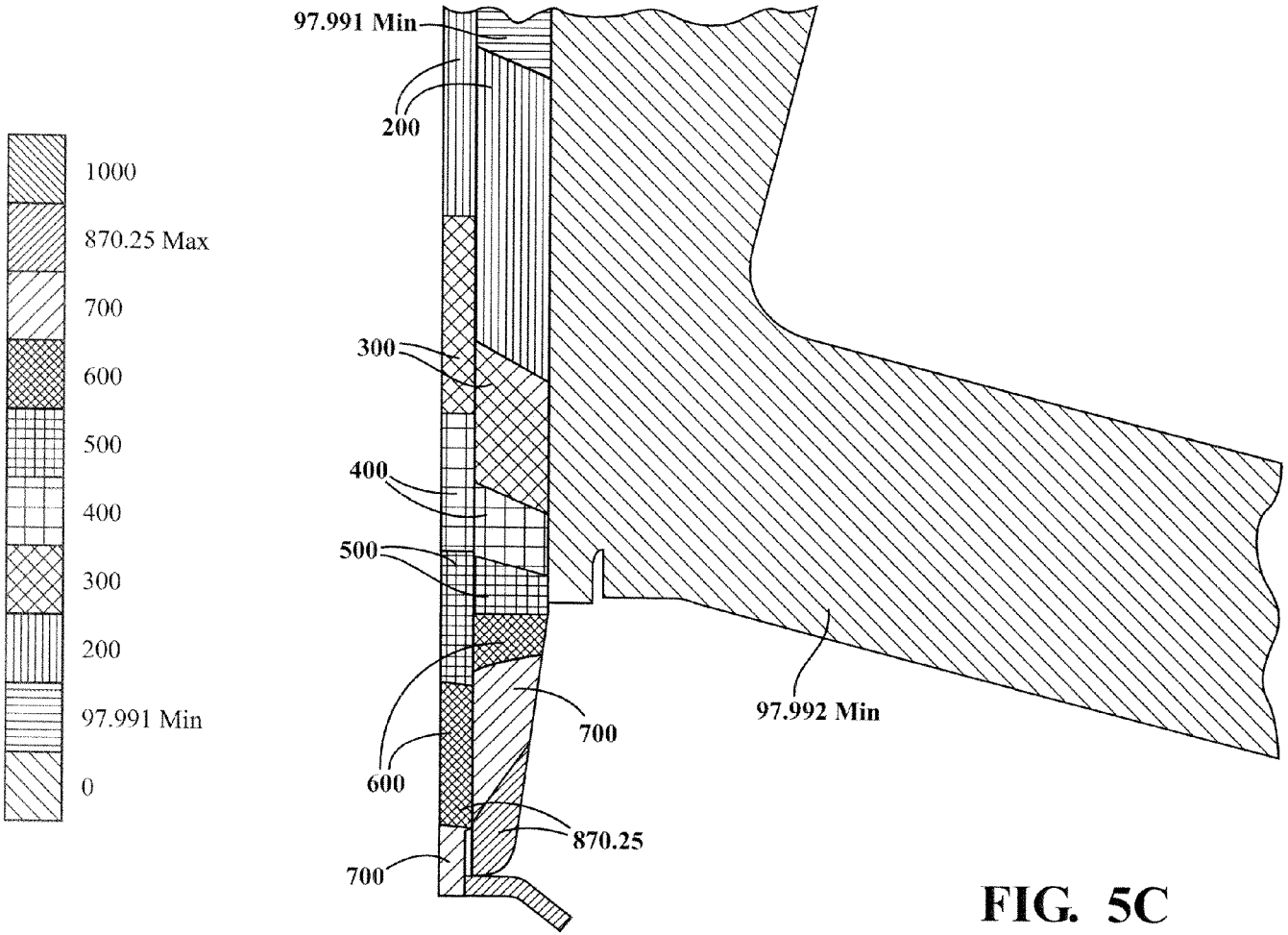
FIG. 5C provides a FEA of a corona igniter in accordance with one aspect of the invention.

FIG. 4 illustrates a corona igniter of the prior art, and FIG. 5A is a Finite Element Analysis (FEA) of the corona igniter of FIG. 4. FIG. 5B provides another FEA of a prior art corona igniter, and FIG. 5C provides a FEA of the inventive corona igniter. The igniters were all tested under the same operating conditions so that the temperature control provided by the igniters could be compared.

The central electrode of the prior art corona igniter of FIG. 5A consists entirely of a nickel alloy and has a diameter less than the diameter of the inventive corona igniter. The FEA analysis indicates that the operating temperature at the firing end of this igniter approaches 950° C., which not ideal for ignition performance. Over time, this high temperature can cause poor endurance and engine damage.

FIG. 5B is a FEA analysis of a prior art corona igniter similar to that of FIG. 4, except with a larger central electrode, similar to central electrodes used in spark plugs. In this case, the temperature of the central electrode is lower than the central electrode of FIG. 5A, but the temperature at electrode firing end and the insulator nose end is still over 900° C.

FIG. 5C is a FEA analysis of a corona igniter 20 according to one embodiment of the present invention, wherein the central electrode 24 includes the core material 30, specifically copper, surrounded by the clad material 32, specifically a nickel alloy. In this embodiment, the core material 30 is disposed at the electrode terminal end 34, the core length $I_c$ is equal to at least 90% of the electrode length $I_e$, at least 97% of the core length $I_c$ is surrounded by the insulator 26, and the central electrode 24 has an increased electrode diameter, compared to the electrode diameter of FIG. 5A. The FEA analysis shows that the temperature at the electrode firing end 36 and the insulator nose end 52 is significantly less than the temperatures of the prior art. The temperature at the insulator nose end 52 of the inventive corona igniter 20 is approximately 870.25° C., max., whereas the temperature at the insulator nose end of the prior art igniters are 947.2° C., max. and 907.59° C., max. The temperature at the electrode firing end 36 of the inventive corona igniter 20 is approximately 700° C., max., whereas the temperature at the electrode firing end of the prior art igniters is 947.2° C., max. and 907.59° C., max.

Figure 6:
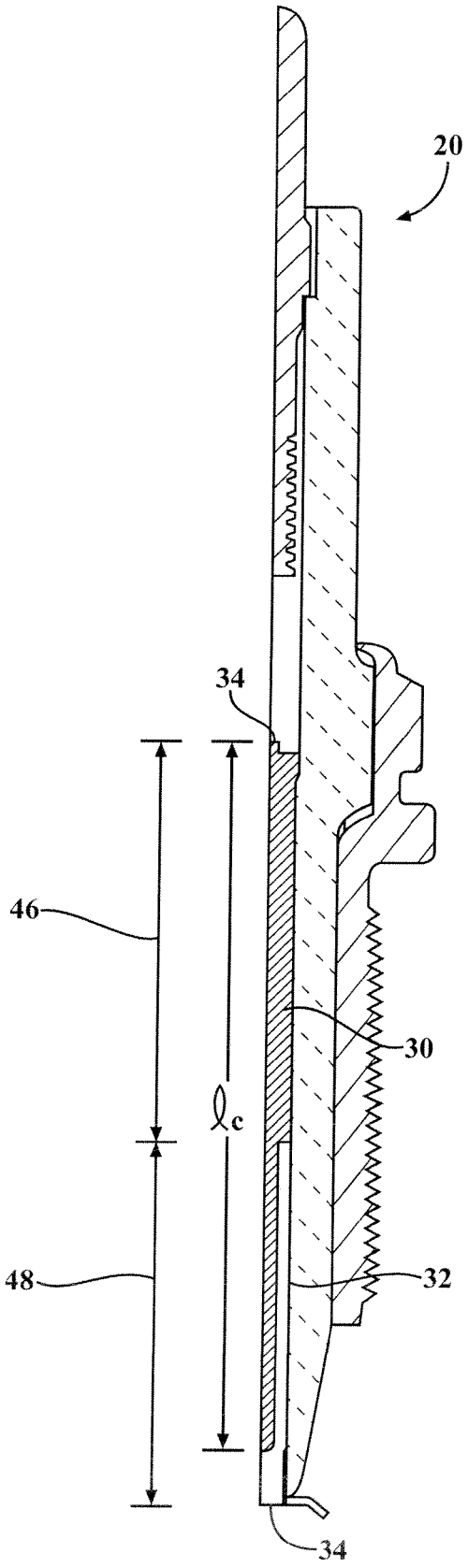
FIG. 6 is a cross-sectional view of a corona igniter according to yet another aspect of the invention.
Figure 6A:
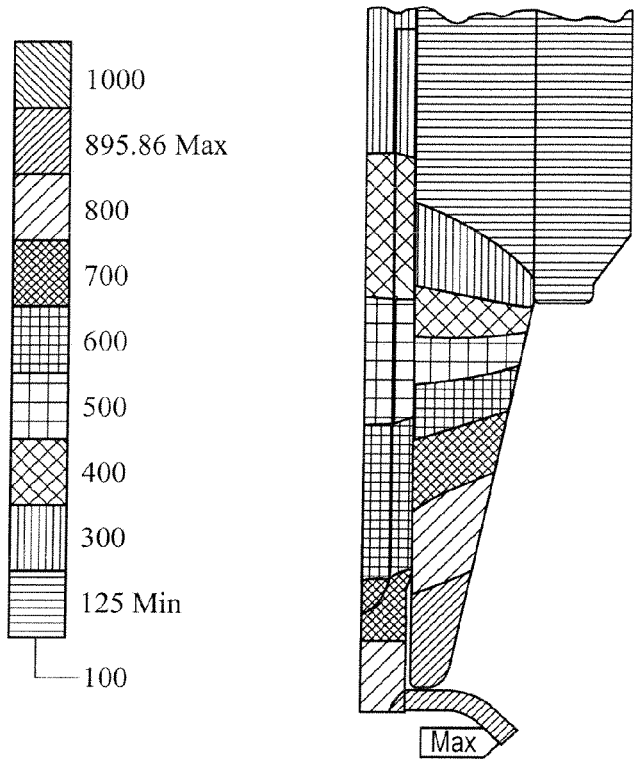
FIGS. 6A-6E provide FEAs of the corona igniter of FIG. 6.
Figure 6B:
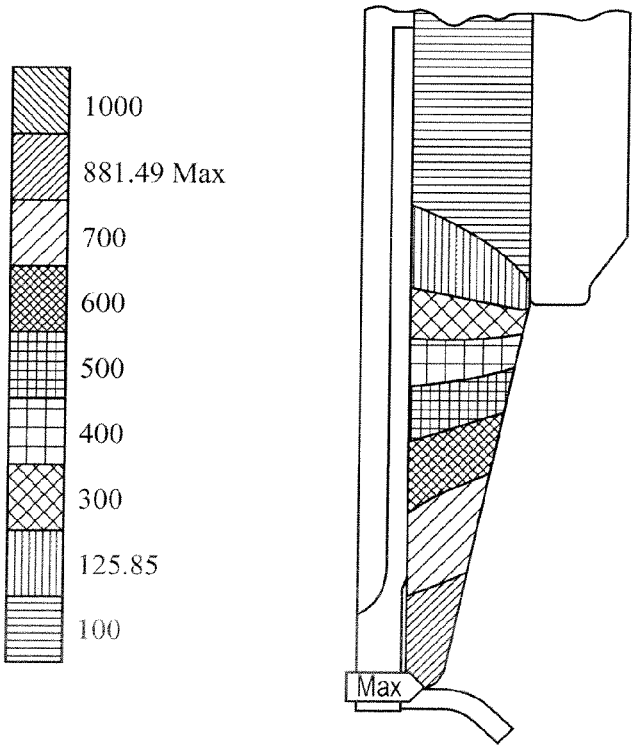
Figure 6C:
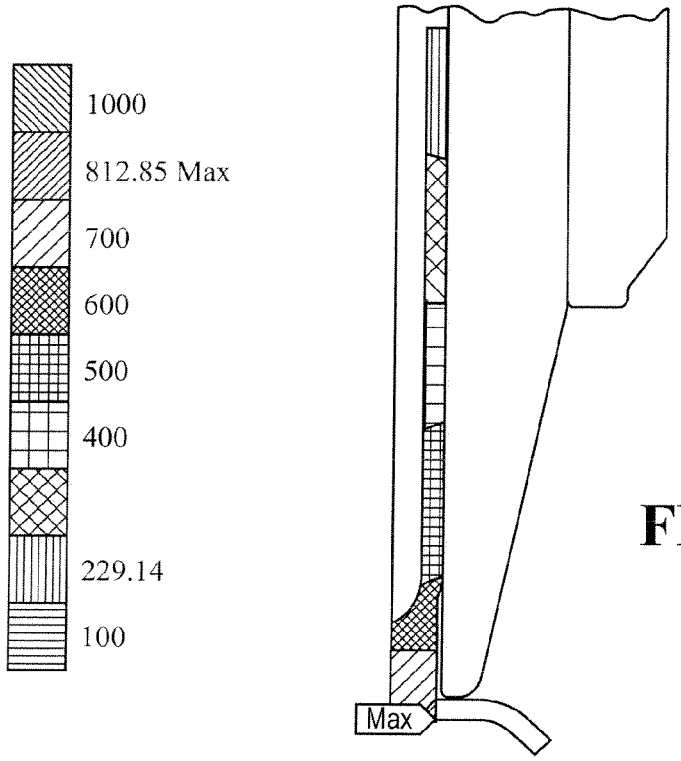
Figure 6D:
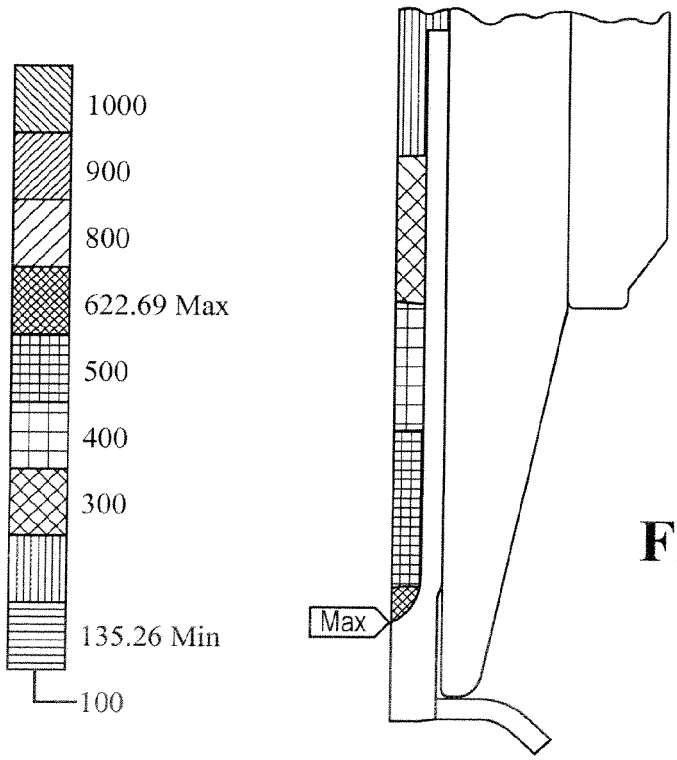
Figure 6E:
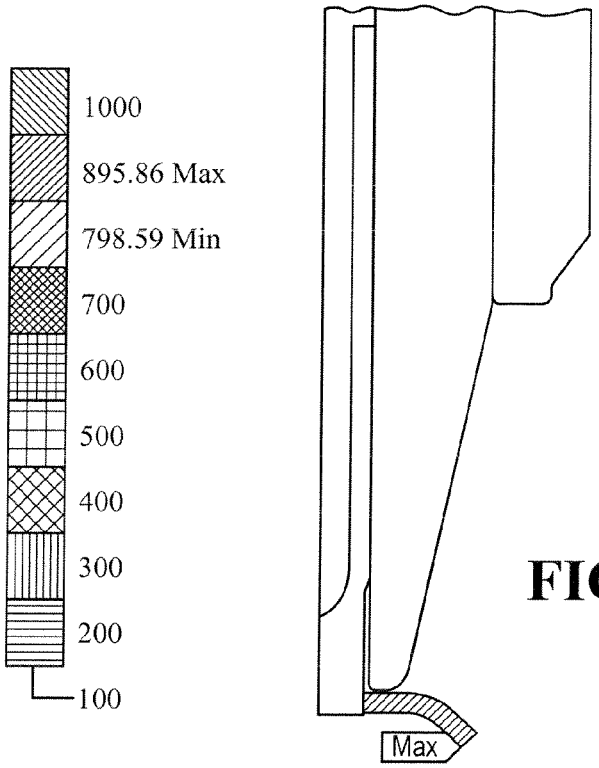

FIG. 6 a cross-sectional view of the corona igniter 20 according to one embodiment of the invention, wherein the core material 30 of the central electrode 24 is disposed at the electrode terminal end 34. In this embodiment, the core material 30 is copper and the clad material 32 is nickel. The core length $I_c$ of said core material 30 is equal to at least 90% of the electrode length $I_e$ of the central electrode 24 and at least 97% of the core length $I_c$ of the core material 30 is surrounded by the insulator 26. Also in this embodiment, the top section 46 consists entirely of the core material 30 and the head of the central electrode 24 consists entirely of the core material 30. The bottom section 48 of the central electrode 24 includes the core material 30 surrounded by the clad material 32. FIGS. 6A-6E each include a Finite Element Analysis (FEA) of a section of the corona igniter 20 of FIG. 6.

Figure 7A:
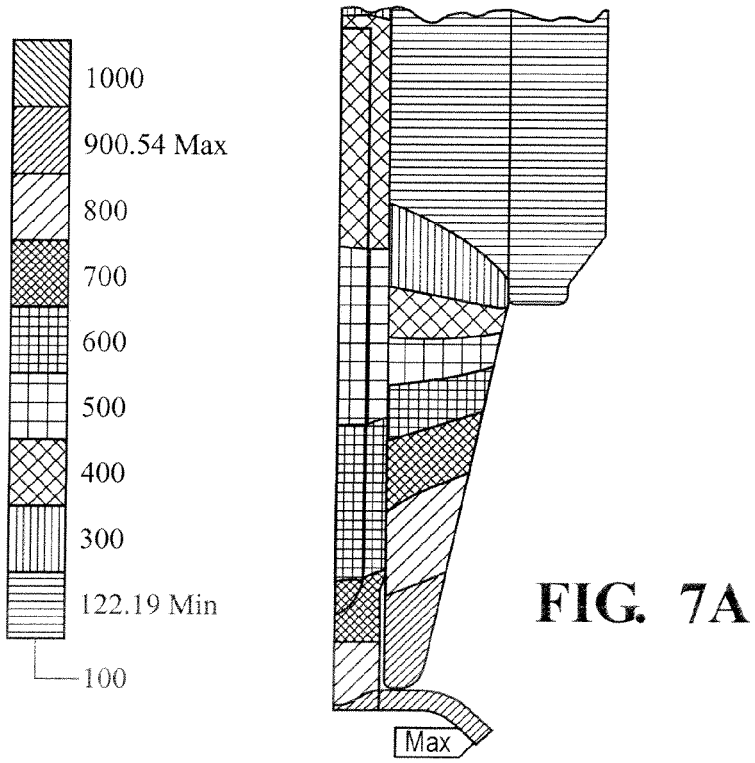
FIGS. 7A-7E provide FEAs of the corona igniter of FIG. 7.
Figure 7:
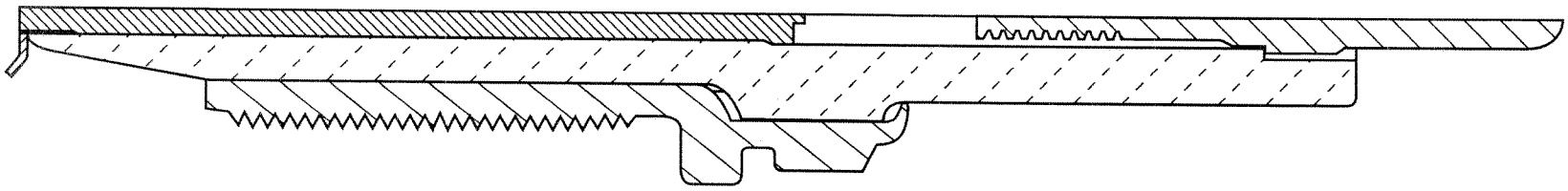
FIG. 7 is a cross-sectional view of a comparative corona igniter.
Figure 7B:
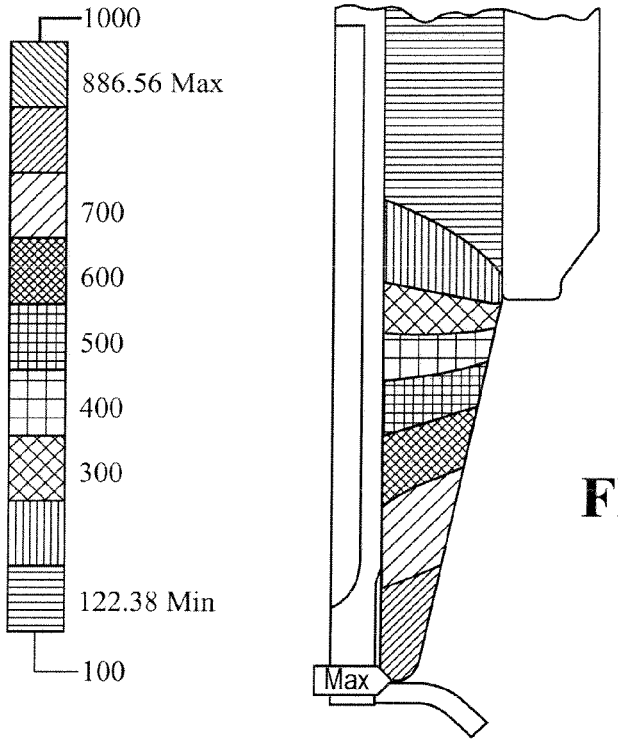
Figure 7C:
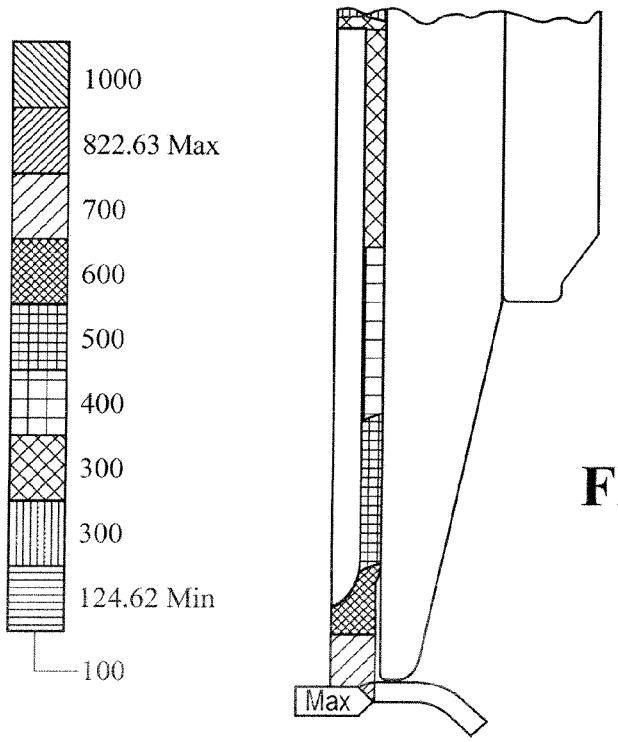
Figure 7D:
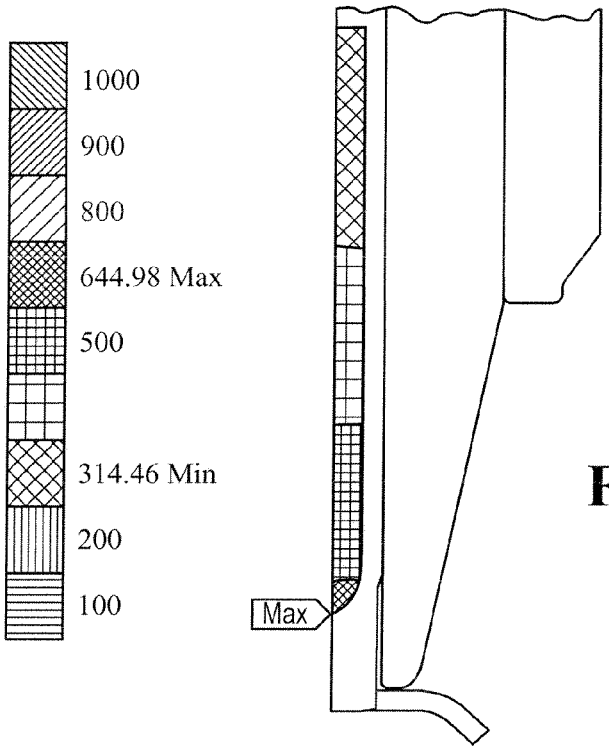
Figure 7E:
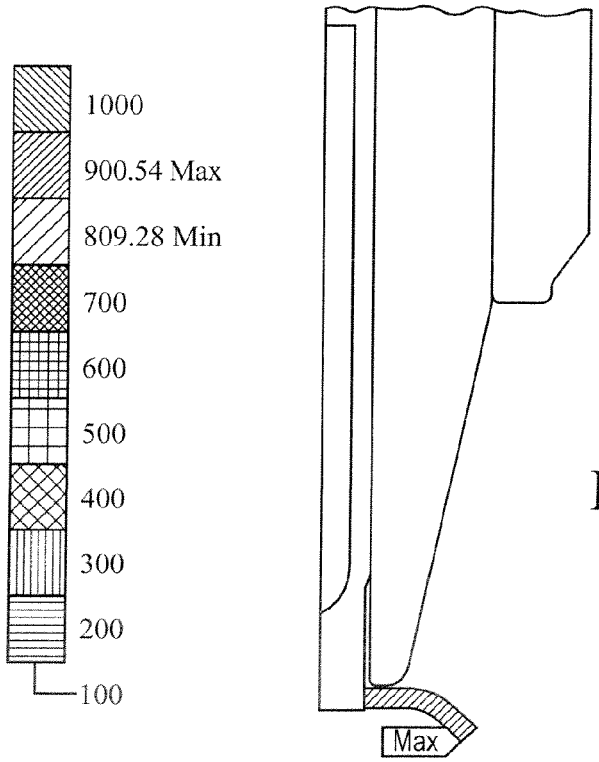

FIG. 7 is a cross-sectional view of a comparative corona igniter, wherein the core material is copper and the clad material is nickel, but the core material is only present in the bottom section of the central electrode, and the top section consists entirely of the clad material. FIGS. 7A-7E each include a Finite Element Analysis (FEA) of a section of the corona igniter 20 of FIG. 7

Figure 8:
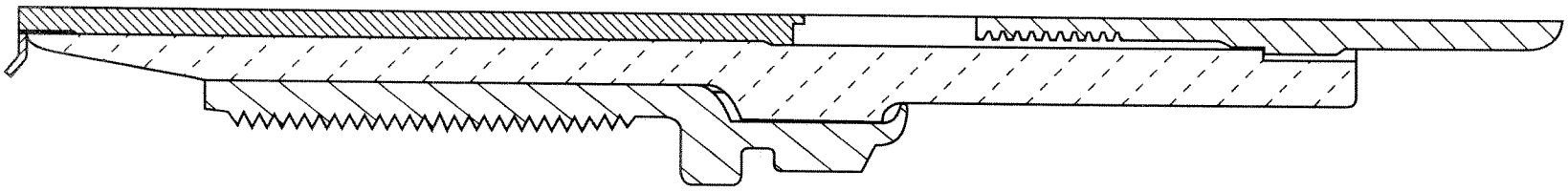
FIG. 8 is a cross-sectional view of a corona igniter according to yet another aspect of the invention.
Figure 8A:
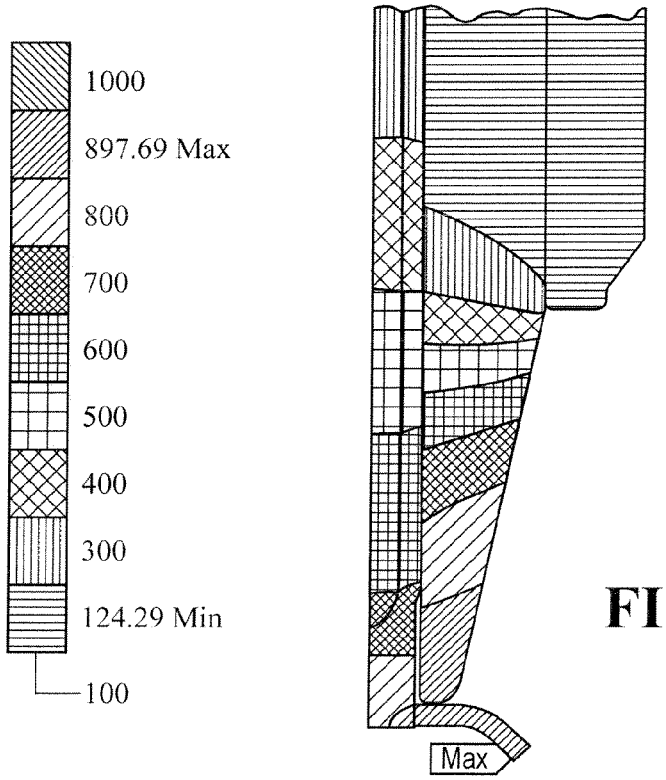
Figure 8B:
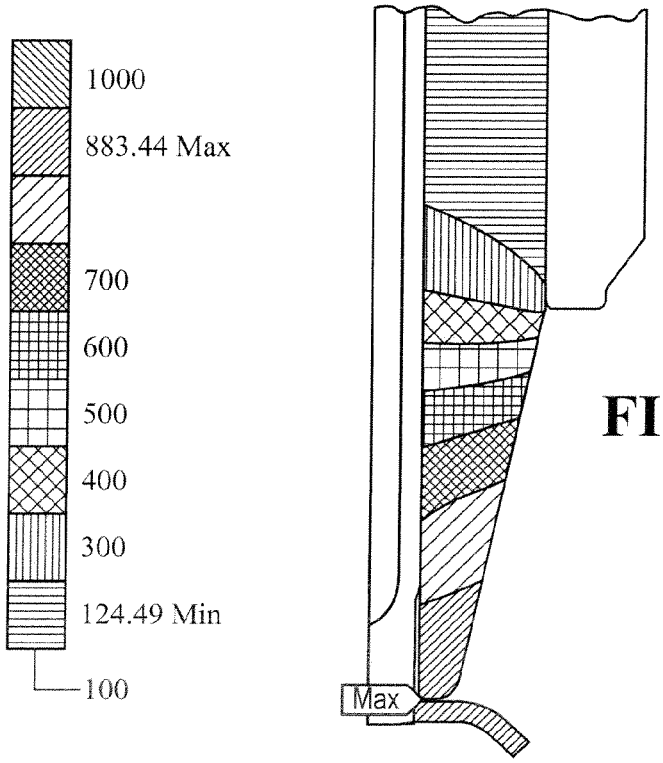
Figure 8C:
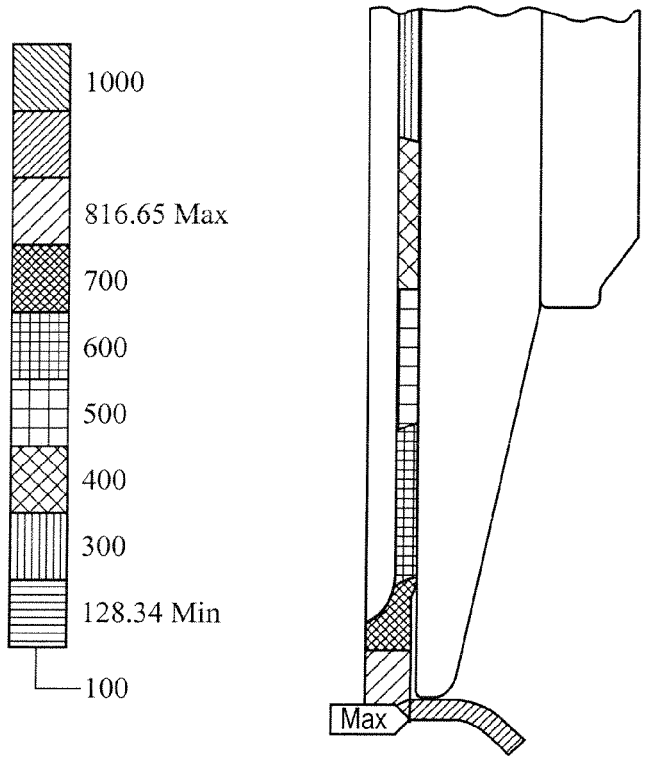
Figure 8D:
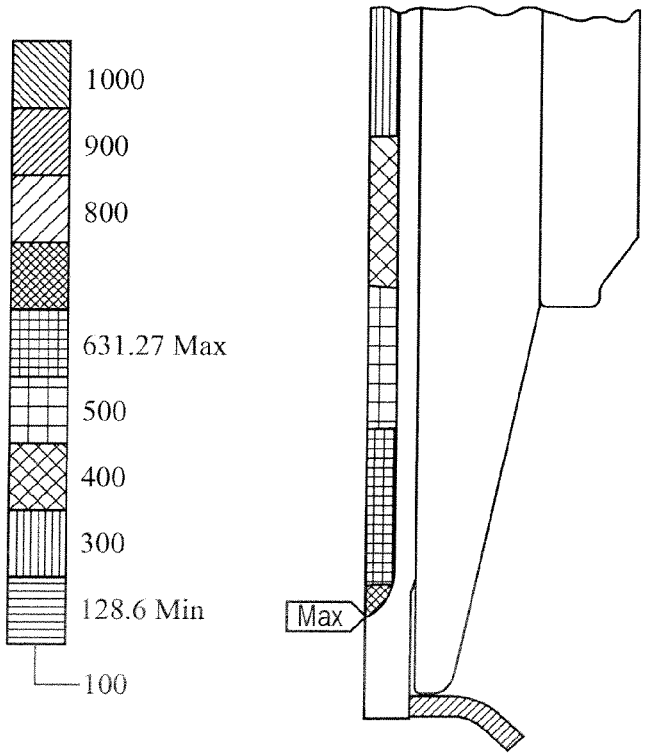

FIG. 8 is cross-sectional view of the corona igniter 20 according to another embodiment of the invention, wherein the core material 30 is surrounded by the clad material 32, the core length $I_c$ of the core material 30 is equal to at least 90% of the electrode length $I_e$ of the central electrode 24 and at least 97% of the core length $I_c$ of the core material 30 is surrounded by the insulator 26. In this embodiment, the core material 30 is copper and the clad material 32 is nickel. Also in this embodiment, the core material 30 of the central electrode 24 is disposed at the electrode terminal end 34 FIGS. 8A-8E each include a Finite Element Analysis (FEA) of a section of the corona igniter 20 of FIG. 8.

FIG. 9 is a graph of the FEA test results of FIGS. 6-8. The test results indicate the corona igniter 20 of FIGS. 6 and 8 provide lower operating temperatures at the electrode firing end 36, the insulator nose end 52, the firing tip 49, and along the core material 30 and the clad material 32, relative to the comparative corona igniter of FIG. 7. In FIG. 9, "CE" means central electrode.

Obviously, many modifications and variations of the present invention are possible in light of the above teachings and may be practiced otherwise than as specifically described while within the scope of the appended claims. In addition, the reference numerals in the claims are merely for convenience and are not to be read in any way as limiting.

What is claimed is:

1. A corona igniter for providing a corona discharge, comprising: a central electrode extending longitudinally from an electrode terminal end to an electrode firing end; said central electrode including a core material surrounded by a clad material, wherein each of said materials of said central electrode have a thermal conductivity, and said thermal conductivity of said core material is greater than said thermal conductivity of said clad material; an insulator formed of an electrically insulating material disposed around said central electrode; a shell formed of an electrically conductive material disposed around said insulator; and wherein said core material of said central electrode is disposed at said electrode terminal end.

2. The corona igniter of claim 1, wherein said central electrode presents an electrode length extending longitudinally from said electrode terminal end to said electrode firing end; said core material of said central electrode presents a core length extending longitudinally between said electrode terminal end and said electrode firing end; and said core length of said core material is equal to at least 90% of said electrode length of said central electrode.

3. The corona igniter of claim 1, wherein said core material is spaced from said electrode firing end by said clad material.

4. The corona igniter of claim 1, wherein said central electrode presents an electrode length extending longitudinally from said electrode terminal end to said electrode firing end; said core material presents a core length extending longitudinally between said electrode terminal end and said electrode firing end; said core length of said core material is equal to at least 90% of said electrode length of said central electrode; and at least 97% of said core length of said core material is surrounded by said insulator.

5. The corona igniter of claim 1, wherein said insulator has an insulator outer surface facing said shell and an insulator inner surface facing said central electrode, said insulator outer surface and said insulator inner surface present an insulator thickness therebetween; said clad material of said central electrode has a clad outer surface facing said insulator inner surface and a clad inner surface facing said core material, said clad outer surface and said clad inner surface present a clad thickness therebetween; said core material of said central electrode has a core outer surface facing said clad inner surface, said core outer surface presents a core diameter; and said clad thickness is equal to at least 5% of said insulator thickness and said core diameter is equal to at least 30% of said insulator thickness.

6. The corona igniter of claim 5, wherein said shell has a shell inner surface facing said insulator, said shell inner surface presents a shell diameter; and said insulator thickness is equal to at least 20% of said shell diameter.

7. The corona igniter of claim 5, wherein said insulator thickness is from 2.5 mm to 3.4 mm, said clad thickness is from 0.25 mm to 0.35 mm, and said core diameter is from 1.4 to 1.7 mm.

8. The corona igniter of claim 1, wherein said clad material of said central electrode has a clad outer surface facing said insulator, said clad outer surface presents a clad diameter; said core material of said central electrode has a core outer surface facing said clad inner surface, said core outer surface presents a core diameter; and said core diameter is equal to at least 65% of said clad diameter.

9. The corona igniter of claim 1, wherein said central electrode presents an electrode length extending from said electrode terminal end to said electrode firing end; at least 40% of said electrode length of said central electrode forms a top section and at least 40% of said electrode length of said central electrode forms a bottom section; said top section extends from said electrode terminal end to said bottom section; said bottom section includes said core material surrounded by said clad material; and said top section consists entirely of said core material.

10. The corona igniter of claim 1, wherein said central electrode comprises a tube formed of said clad material filled with said core material.

11. The corona igniter of claim 1, wherein said shell extends longitudinally from a shell upper end to a shell lower end; said insulator has an insulator outer surface presenting an insulator outer diameter and extends longitudinally from an insulator upper end to an insulator nose end; said insulator includes an insulator first region extending outwardly from said shell upper end to said insulator upper end; said insulator includes an insulator middle region extending from said insulator first region toward said insulator nose end; said insulator includes an insulator second region extending from said insulator middle region toward said insulator nose end; said insulator outer diameter of said insulator middle region is greater than said insulator outer diameter of said insulator first region and said insulator second region; said insulator includes an insulator upper shoulder between said insulator first region and said insulator middle region; said insulator includes an insulator lower shoulder between said insulator middle region and said insulator second region; said shell surrounds said insulator lower shoulder and said insulator middle region and said insulator upper shoulder to fix said shell to said insulator; said central electrode presents an electrode length extending from said electrode terminal end to said electrode firing end; and at least 80% of said electrode length of said central electrode is disposed between said insulator lower shoulder and said insulator nose end.

12. The corona igniter of claim 11 including a pair of gaskets disposed between said insulator and said shell, wherein one of said gaskets is disposed along said insulator upper shoulder and the other is disposed along said insulator lower shoulder.

13. The corona igniter of claim 1, wherein said core material consists of copper or a copper alloy and said clad material consists of nickel or a nickel alloy.

14. A corona igniter for providing a corona discharge, comprising: a central electrode having an electrode length extending longitudinally from an electrode terminal end to an electrode firing end; said central electrode comprising a core material surrounded by a clad material, wherein each of said materials of said central electrode have a thermal conductivity, and said thermal conductivity of said core material is greater than said thermal conductivity of said clad material; said core material of said central electrode presents a core length extending longitudinally between said electrode terminal end and said electrode firing end; an insulator formed of an electrically insulating material disposed around said central electrode and extending longitudinally from an insulator upper end to an insulator nose end; a shell formed of an electrically conductive material disposed around said insulator; and wherein said core length of said core material is equal to at least 90% of said electrode length of said central electrode and at least 97% of said core length of said core material is surrounded by said insulator.

15. The corona igniter of claim 14, wherein said core material is spaced from said electrode terminal end by said clad material.

16. The corona igniter of claim 14, wherein said insulator has an insulator outer surface facing said shell and an insulator inner surface facing said central electrode, said insulator outer surface and said insulator inner surface present an insulator thickness therebetween; said clad material of said central electrode has a clad outer surface facing said insulator inner surface and a clad inner surface facing said core material, said clad outer surface and said clad inner surface present a clad thickness therebetween; said core material of said central electrode has a core outer surface facing said clad inner surface, said core outer surface presents a core diameter; and said clad thickness is equal to at least 5% of said insulator thickness and said core diameter is equal to at least 30% of said insulator thickness.

17. The corona igniter of claim 16, wherein said shell has a shell inner surface facing said insulator, said shell inner surface presents a shell diameter; and said insulator thickness is equal to at least 20% of said shell diameter.

18. The corona igniter of claim 16, wherein said insulator thickness is from 2.5 mm to 3.4 mm, said clad thickness is from 0.25 mm to 0.35 mm, and said core diameter is from 1.4 mm to 1.7 mm.

19. The corona igniter of claim 14, wherein said clad material of said central electrode has a clad outer surface facing said insulator, said clad outer surface has a clad diameter; said core material of said central electrode has a core outer surface facing said clad inner surface, said core outer surface presents a core diameter; and said core diameter is equal to at least 65% of said clad diameter.

20. The corona igniter of claim 14, wherein said electrode firing end of said central electrode is disposed outwardly of said insulator nose end.

21. The corona igniter of claim 14, wherein at least 40% of said electrode length of said central electrode forms a top section and at least 40% of said electrode length forms a bottom section; said top section extends from said electrode terminal end to said bottom section; said bottom section includes said core material surrounded by said clad material; and said top section consists entirely of said core material.

22. The corona igniter of claim 14, wherein said central electrode comprises of a tube formed of said clad material filled with said core material.

23. The corona igniter of claim 14, wherein said shell extends longitudinally from a shell upper end to a shell lower end; said insulator has an insulator outer surface presenting an insulator outer diameter extending longitudinally from an insulator upper end to an insulator nose end; said insulator includes an insulator first region extending outwardly from said shell upper end to said insulator upper end; said insulator includes an insulator middle region extending from said insulator first region toward said insulator nose end; said insulator includes an insulator second region extending from said insulator middle region toward said insulator nose end; said insulator outer diameter of said insulator middle region is greater than said insulator outer diameter of said insulator first region and said insulator outer diameter of said insulator second region; said insulator includes an insulator upper shoulder between said insulator first region and said insulator middle region; said insulator includes an insulator lower shoulder between said insulator middle region and said insulator second region; said shell surrounds said insulator lower shoulder and said insulator middle region and said insulator upper shoulder to fix said shell to said insulator; and at least 80% of said electrode length of said central electrode is disposed between said insulator lower shoulder and said insulator nose end.

24. The corona igniter of claim 23 including a pair of gaskets disposed between said insulator and said shell, wherein one of said gaskets is disposed along said insulator upper shoulder and the other is disposed along said insulator lower shoulder.

25. The corona igniter of claim 14, wherein said core material consists of copper or a copper alloy and said clad material consists of nickel or a nickel alloy.

26. The corona igniter of claim 14, wherein said core material of said central electrode is disposed at said electrode terminal end.

27. A corona igniter for providing a corona discharge, comprising: a central electrode extending longitudinally from an electrode terminal end to an electrode firing end; said central electrode including a core material surrounded by a clad material, wherein each of said materials of said central electrode have a thermal conductivity, and the thermal conductivity of said core material is greater than the thermal conductivity of said clad material; an insulator formed of an electrically insulating material disposed around said central electrode; a shell formed of an electrically conductive material disposed around said insulator; said insulator having an insulator outer surface facing said shell and an insulator inner surface facing said central electrode, said insulator outer surface and said insulator inner surface presenting an insulator thickness therebetween; said clad material of said central electrode having a clad outer surface facing said insulator inner surface and a clad inner surface facing said core material, said clad outer surface and said clad inner surface presenting a clad thickness therebetween; said core material of said central electrode having a core outer surface facing said clad inner surface, said core outer surface presenting a core diameter; and said clad thickness being equal to at least 5% of said insulator thickness and said core diameter being equal to at least 30% of said insulator thickness.

28. The corona igniter of claim 27, wherein said shell has a shell inner surface facing said insulator, said shell inner surface presents a shell diameter; and said insulator thickness is equal to at least 20% of said shell diameter.

29. The corona igniter of claim 27, wherein said insulator thickness is from 2.5 mm to 3.4 mm, said clad thickness is from 0.25 mm to 0.35 mm, and said core diameter is from 1.4 mm to 1.7 mm.

30. The corona igniter of claim 27, wherein said clad material of said central electrode has a clad outer surface facing said insulator inner surface and presents a clad diameter; and said insulator outer diameter adjacent said central electrode is from 7.0 mm to 12.5 mm and said clad diameter is from 2.0 mm to 2.8 mm.

31. The corona igniter of claim 27, wherein said clad material of said central electrode has a clad outer surface facing said insulator, said clad outer surface presents a clad diameter; said core material of said central electrode presents a core outer surface facing said clad, said core outer surface presents a core diameter; and said core diameter is equal to at least 65% of said clad diameter.

32. The corona igniter of claim 27, wherein said central electrode has an electrode length extending from said electrode terminal end to said electrode firing end; at least 40% of said electrode length of said central electrode forms a top section and at least 40% of said electrode length of said central electrode forms a bottom section; said top section extends from said electrode terminal end to said bottom section, said bottom section includes said core material surrounded by said clad material; and said top section consists entirely of said core material.

33. The corona igniter of claim 27, wherein said central electrode comprises a tube formed of said clad material surrounding said core material.

34. The corona igniter of claim 27, wherein said shell extends longitudinally from a shell upper end to a shell lower end; said insulator outer surface presents an insulator outer diameter and extends longitudinally from an insulator upper end to an insulator nose end; said insulator includes an insulator first region extending outwardly from said shell upper end to said insulator upper end; said insulator includes an insulator middle region extending from said insulator first region toward said insulator nose end; said insulator includes an insulator second region extending from said insulator middle region toward said insulator nose end; said insulator outer diameter of said insulator middle region is greater than said insulator outer diameter of said insulator first region and said insulator second region; said insulator includes an insulator upper shoulder between said insulator first region and said insulator middle region; said insulator includes an insulator lower shoulder between said insulator middle region and said insulator second region; said shell surrounds said insulator lower shoulder and said insulator middle region and said insulator upper shoulder to fix said shell to said insulator; said central electrode presents an electrode length extending from said electrode terminal end to said electrode firing end; and at least 80% of said electrode length of said central electrode is disposed between said insulator lower shoulder and said insulator nose end.

35. The corona igniter of claim 27, including a pair of gaskets disposed between said insulator and said shell, wherein one of said gaskets is disposed along said insulator upper shoulder and the other is disposed along said insulator lower shoulder.

36. The corona igniter of claim 27, wherein said core material consists of copper or a copper alloy and said clad material consists of nickel or a nickel alloy.

* * * * *